US010976142B1

(12) United States Patent
Hilt

(10) Patent No.: US 10,976,142 B1
(45) Date of Patent: Apr. 13, 2021

(54) TOY ARROW PROJECTILE

(71) Applicant: Garrett Hilt, Bakersfield, CA (US)

(72) Inventor: Garrett Hilt, Bakersfield, CA (US)

( * ) Notice: Subject to any disclaimer, the term of this patent is extended or adjusted under 35 U.S.C. 154(b) by 0 days.

(21) Appl. No.: 16/841,442

(22) Filed: Apr. 6, 2020

(51) Int. Cl.

| | |
|---|---|
| ***F42B 6/04*** | (2006.01) |
| ***F42B 6/08*** | (2006.01) |
| ***A63H 27/00*** | (2006.01) |
| ***F42B 6/06*** | (2006.01) |

(52) U.S. Cl.
CPC ..... *F42B 6/08* (2013.01); *A63H 27/005* (2013.01); *F42B 6/04* (2013.01); *F42B 6/06* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 2,565,176 A | | 8/1951 | Hockett | |
| 2,735,221 A | | 2/1956 | Fields | |
| 3,103,213 A | | 9/1963 | Robinson | |
| 3,277,878 A | | 10/1966 | Pankratz | |
| 3,465,472 A | | 9/1969 | Novotny | |
| 4,392,654 A | * | 7/1983 | Carella | F41B 5/1446 264/145 |
| 4,502,692 A | * | 3/1985 | Humphrey | F42B 6/06 473/586 |
| 6,500,042 B1 | * | 12/2002 | LaPointe | A63H 33/18 124/20.3 |
| 8,662,060 B2 | | 3/2014 | Walterscheid et al. | |
| 8,689,773 B2 | | 4/2014 | Walterscheid et al. | |
| 8,991,373 B2 | * | 3/2015 | Cummings | F41B 3/02 124/20.3 |
| 9,091,514 B1 | | 7/2015 | Cummings | |
| 9,239,205 B2 | | 1/2016 | Cummings | |
| 10,422,605 B2 | | 9/2019 | Shapiro | |
| 2015/0260475 A1 | | 9/2015 | Monnig et al. | |
| 2016/0153738 A1 | * | 6/2016 | Cummings | F41B 5/0094 124/20.3 |
| 2019/0011215 A1 | | 1/2019 | Shaffer et al. | |

* cited by examiner

*Primary Examiner* — John A Ricci
(74) *Attorney, Agent, or Firm* — Goldstein Law Offices, P.C.

(57) ABSTRACT

A toy arrow projectile for use with a toy projectile launching assembly is disclosed. The toy arrow projectile includes a shaft including a front end and a tail end, a pair of hook elements extending outwardly from the front end, a safety-tipped toy arrowhead attached to the front end, and arcuate fletching attached to the tail end. The pair of hook elements are configured to engage launching elements of the toy projectile launching assembly to stretch the launching elements therewith. The fletching includes arcuate fins extending along the shaft towards the front end. The arcuate fins include curved surfaces that curve outwardly from the shaft and generate spin in the toy arrow projectile during flight. The fletching includes a cross-sectional diameter having a distance that is less than the distance between the launching elements to allow passage of the toy arrow projectile through the launching elements without obstruction thereby.

15 Claims, 7 Drawing Sheets

TOY ARROW PROJECTILE

TECHNICAL FIELD

The present disclosure relates generally to toy projectiles. More particularly, the present disclosure relates to a toy arrow projectile for use with toy projectile launching assemblies.

BACKGROUND

Conventional toy arrow projectiles include planar vane or fin structures, or fletching, that generally extend perpendicularly relative to the shaft or the head on which they are disposed, much like a real arrow. The fins can extend along a linear or non-linear path up the longitudinally length of the shaft to form differing aerodynamic properties. Indeed, conventional vanes are either straight, i.e., straight on the arrow shaft, offset, i.e., straight on arrow shaft, but turned (offset) so they extend slight diagonally from the front to the back, or helical, i.e., curving slightly as they extend along the shaft. Moreover, fletching can include different sizes, i.e., lengths or heights, to form certain aerodynamic attributes. In terms of the aerodynamics of an arrow, generally, the more the fletching causes the arrow to spin during flight the more stable, or accurate, the arrow is over longer distances.

In real bow and arrow systems, the arrow does not typically pass through an enclosed structure, rather the bow string is pulled back behind the arrow with the arrow's nock and launched through an open space on a side of the bow. Thus, generally, there is no concern that the fletching will obstruct the launch of the arrow by striking an object it is passing through.

However, in certain toy bow and arrow systems at least a portion of the toy arrow projectiles, usually the shaft, pass through an opening formed by a pair of elastic launching elements that in concert launch the toy projectile. As such, toy arrow fletching that is smaller than the opening is required so as to prevent obstruction by the launching elements.

Accordingly, there is a need for a toy arrow projectile including fletching that is able to pass through the opening of the launching elements without interference thereby, while still providing adequate flight stability of the toy projectile.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a toy arrow projectile including fletching that is sized to pass through the opening formed between the elastic launching elements of a toy projectile launching assembly without obstruction thereby. Accordingly, the present disclosure provides a toy arrow projectile including fletching having a cross-sectional diameter that is smaller than the opening formed between the elastic launching elements.

An aspect of an example embodiment in the present disclosure is to provide a toy arrow projectile including fletching shaped to enable the toy arrow projectile to pass through the opening formed between the elastic launching elements of a toy projectile launching assembly without obstruction thereby, while still providing aerodynamic qualities that stabilize the toy arrow projectile during flight. Accordingly, the present disclosure provides a toy arrow projectile including fletching having a plurality of fins that are arcuate in shape so as to cause the toy arrow projectile to spin during flight, thereby increasing the stabilization and accuracy of the toy arrow projectile during flight.

An aspect of an example embodiment in the present disclosure is to provide a toy arrow projectile including hook elements separate from the head/tip of the toy arrow projectile that are configured to vertically engage a pair of parallel elastic launching elements of a toy projectile launching assembly. Accordingly, the present disclosure provides a toy arrow projectile including a pair of hook elements extending outwardly from the shaft and adjacent to the head of the toy arrow projectile that are oppositely disposed relative to each other.

An aspect of an example embodiment in the present disclosure is to provide a toy arrow projectile including a tail that facilitates the drawing of the elastic launching elements of a toy projectile launching assembly with the toy arrow projectile. Accordingly, the present disclosure provides a toy arrow projectile including a pair of finger notches disposed on opposite sides of the tail for grasping by a user.

An aspect of an example embodiment in the present disclosure is to provide a toy arrow projectile including a shaft configured to engage with a fastener on a toy projectile launching assembly. Accordingly, the present disclosure provides a toy arrow projectile including a shaft having a rib disposed thereon that engages a fastener of the toy projectile launching assembly.

An aspect of an example embodiment in the present disclosure is to provide a toy arrow projectile configured to make sound effects during flight. Accordingly, the present disclosure provides a toy arrow projectile including a whistle disposed in the head.

An aspect of an example embodiment in the present disclosure is to provide a toy arrow projectile including an interchangeable head for providing various types of interchangeable toy arrow tips suitable for different games or purposes. Accordingly, the present disclosure provides a toy arrow projectile including a shaft having a front end which includes a fastener configured to removably receive the head.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
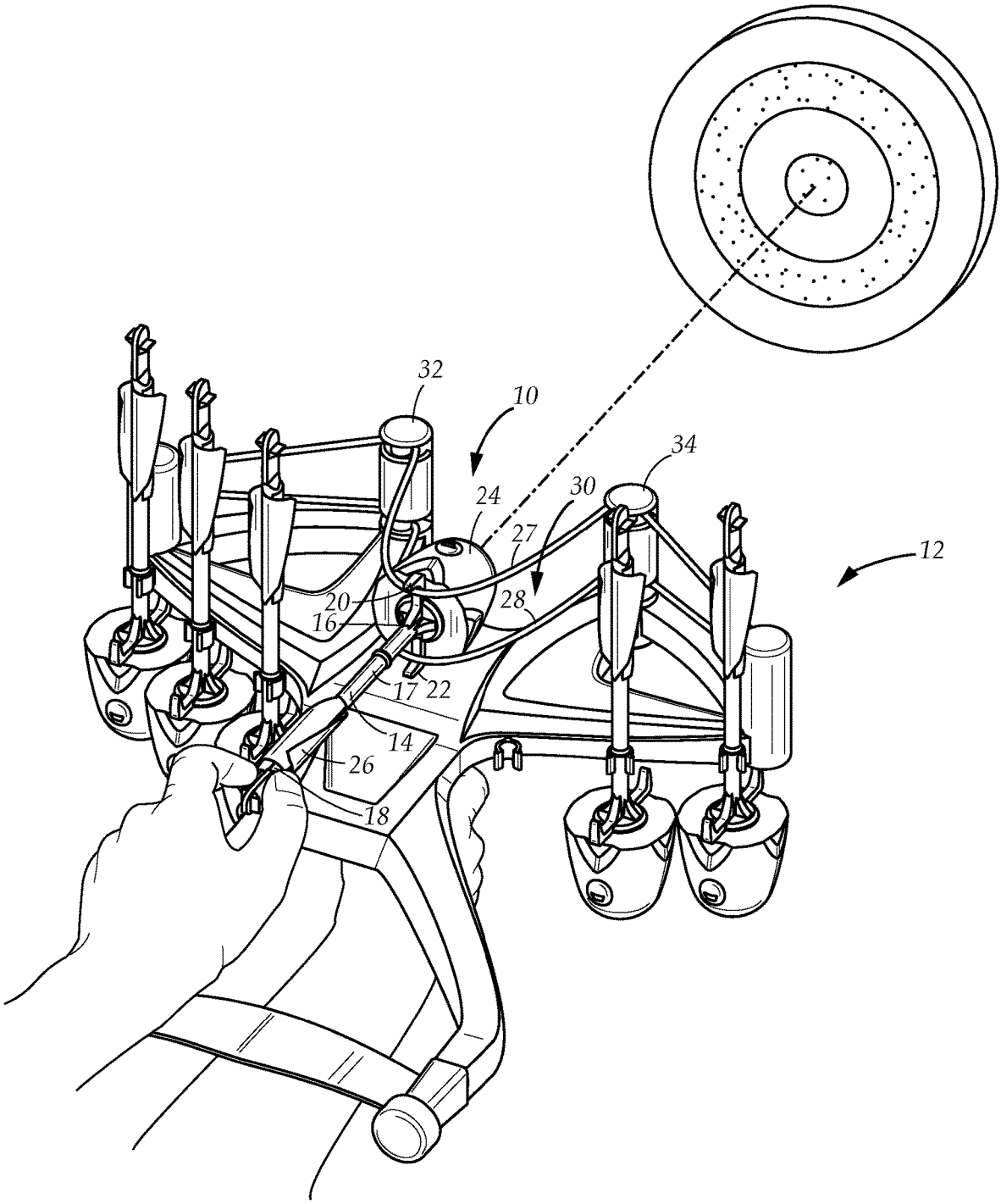
FIG. 1 is a perspective view of the toy arrow projectile in use, illustrating the hook elements engaging the launching elements of a toy projectile launching assembly and the launching elements being drawn by the toy arrow projectile according to one embodiment of the present disclosure.

FIG. 1 illustrates a toy arrow projectile 10 for use with a toy projectile launching assembly 12. The toy arrow projectile comprising an elongated shaft 14 including a front end 16, a tail end 18 opposite the front end 16, a longitudinal length, a diameter, and a curved surface 17, a pair of hook elements 20, 22 extending outwardly from the front end 16, the pair of hook elements 20, 22 opposite each other, and a safety-tipped toy arrowhead 24 attached to the front end 16, the toy arrowhead 24 adjacent to the pair of hook elements 20, 22, and arcuate fletching 26 disposed on the tail end 18.

The pair of hook elements 20, 22 are sized and shaped to engage first and second launching elements 27, 28 as the pair of hook elements 20, 22 are pulled though the gap 30 formed between the first and second launching elements 27, 28. To load the toy arrow projectile 10, the toy arrow projectile 10 is threaded through the gap 30 so that the pair of hook elements 20, 22 engage the first and second launching elements 27, 28. Once engaged with the first and second launching elements 27, 28, the toy arrow projectile 10 is drawn in a manner similar to a traditional crossbow. As the toy arrow projectile 10 is drawn the first and second launching elements 27, 28 stretch. The first and second launching elements 27, 28 bend and pivot about the left and right launch element support structures 32, 34, thereby enabling the first and second launching elements 27, 28 to move with the toy arrow projectile 10.

As the first and second launching elements 27, 28 stretch, they gain potential energy. When the toy arrow projectile 10 is released, the first and second elastic launching elements 27, 28 retract and the toy arrow projectile 10 is accelerated through the left and right launch element support structures 32, 34. The first and second elastic launching elements 27, 28 retracts towards the left and right launch element support structures 32, 34. The momentum in the toy arrow projectile 10 formed by the retraction of the first and second elastic launching elements 27, 28 causes the toy arrow projectile 10 to continue forward and out of the gap 30. This launches the toy arrow projectile 10 into flight as the pair of hook elements 20, 22 disengage the first and second elastic launching elements 27, 28.

Figure 8A:
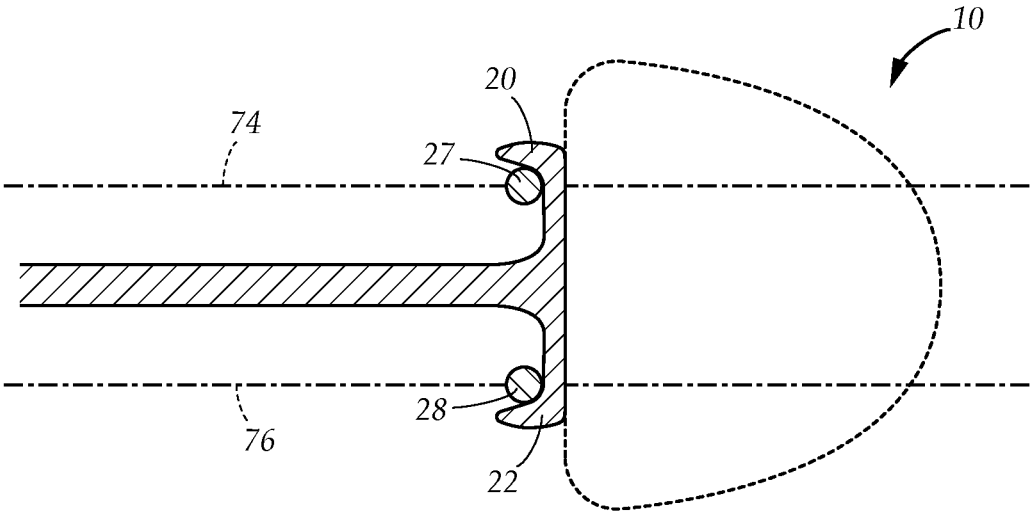
FIG. 8A is a cross-sectional view of the toy arrow projectile engaging the launching elements of the toy projectile launching assembly prior to the launching elements being drawn, illustrating the axes upon which the toy arrow projectile stretches and the launching element travels while being drawn according to one embodiment of the present disclosure.
Figure 8B:
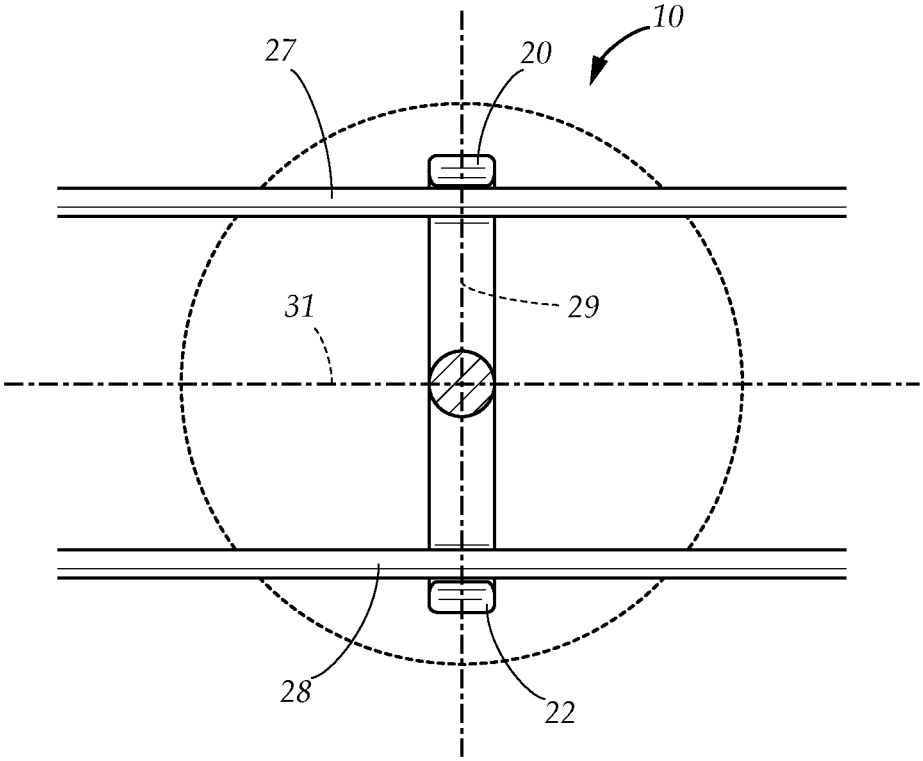
FIG. 8B is a cross-sectional view of the toy arrow projectile engaging the launching elements of the toy projectile launching assembly prior to the launching elements being drawn, illustrating the horizontal and vertical axes upon which the toy arrow projectile applies a force to the launching element while being drawn according to one embodiment of the present disclosure.

Referring to FIGS. 8A and 8B, it can be seen that the pair of hook elements 20, 22 are configured to draw the first and second launching elements 27, 28 along separate but parallel axes 74, 76, respectively, such that the first and second launching elements 27, 28 maintain a fixed normal distance relative to each other when stretching and retracting to launch the toy arrow projectile 10. When the toy arrow projectile 10 is loaded, the pair of hook elements 20, 22 vertically engage the first and second launching elements 27, 28, such that the pair of hook elements 20, 22 are aligned along a vertical axis. The distance between the pair of hook elements 20, 22 is the substantially the same as the distance between the first and second launching elements 27, 28, such that when the pair of hook elements 20, 22 engage the first and second launching elements 27, 28 the pair of hook elements 20, 22 do not alter the position and/or distance between the first and second launching elements 27, 28. This enables the toy arrow projectile 10 to draw the first and second launching elements 27, 28 rearwardly along parallel axes.

When drawing the first and second launching elements 27, 28 with the toy arrow projectile 10, the toy arrow projectile 10 exerts a force along a vertical axis 29 that is orthogonal to the first and second launching elements 27, 28 and a force along a horizontal axis 31 that is parallel to the first and second launching elements 27, 28. Accordingly, when the toy arrow projectile 10 is released, a reciprocal vertical and horizontal force is exerted onto the toy arrow projectile 10, which stabilizes the toy arrow projectile 10 along a linear trajectory, minimizing any rotational force or pull created by the first and second launching elements 27, 28 and/or exerted on the toy arrow projectile 10 by the first and second launching elements 27, 28.

Figure 4:
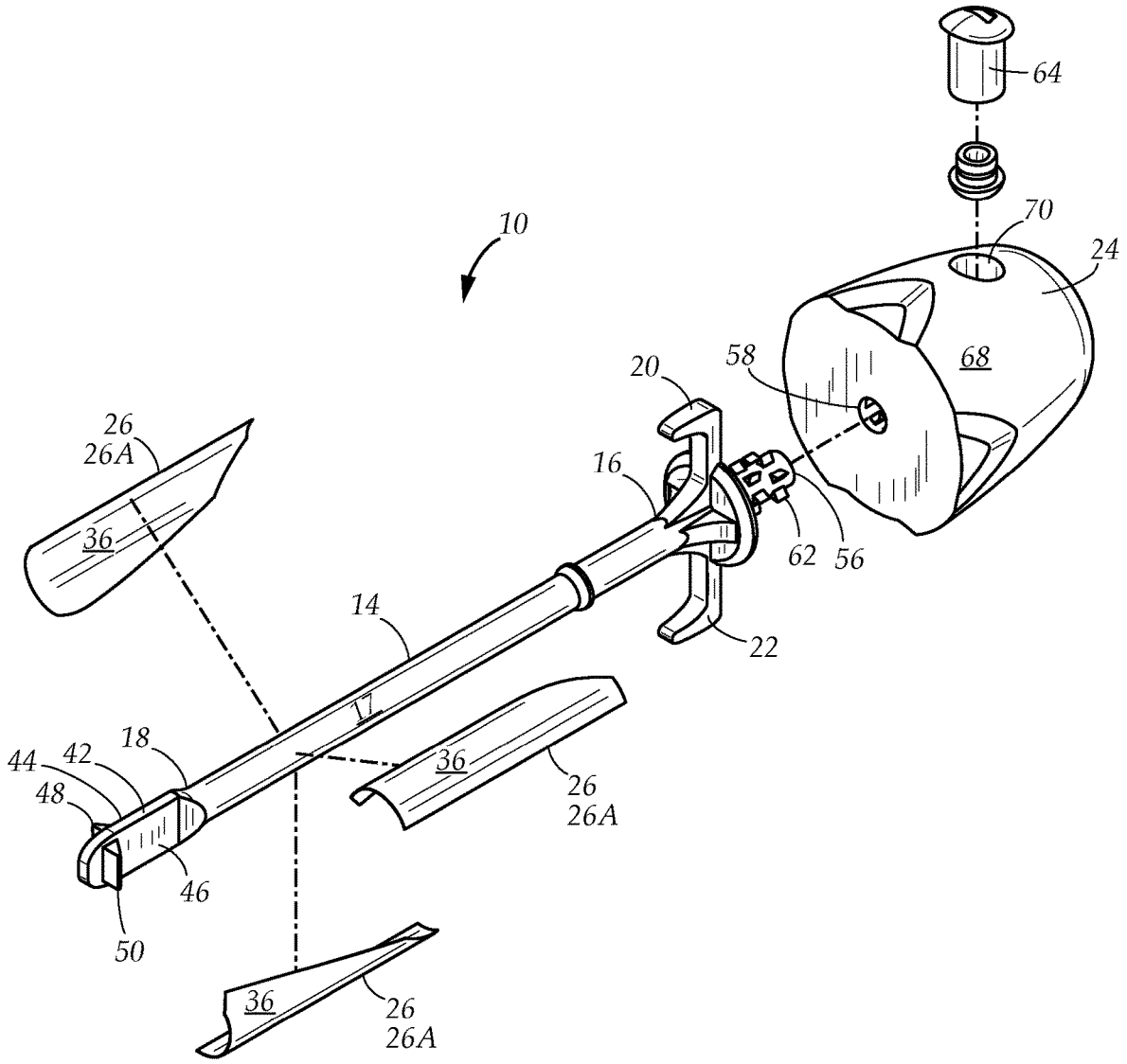
FIG. 4 is an exploded view of the toy arrow projectile, illustrating the various components of the toy arrow projectile according to one embodiment of the present disclosure.
Figure 5A:
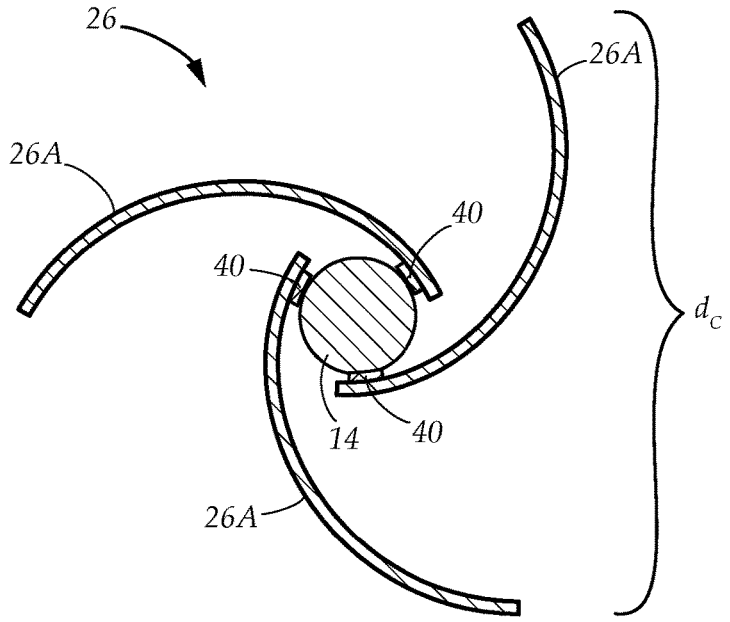
FIG. 5A is a cross-sectional view of the fletching of the toy arrow projectile, illustrating the cross-sectional shape of the fins of the fletching according to one embodiment of the present disclosure.
Figure 5B:
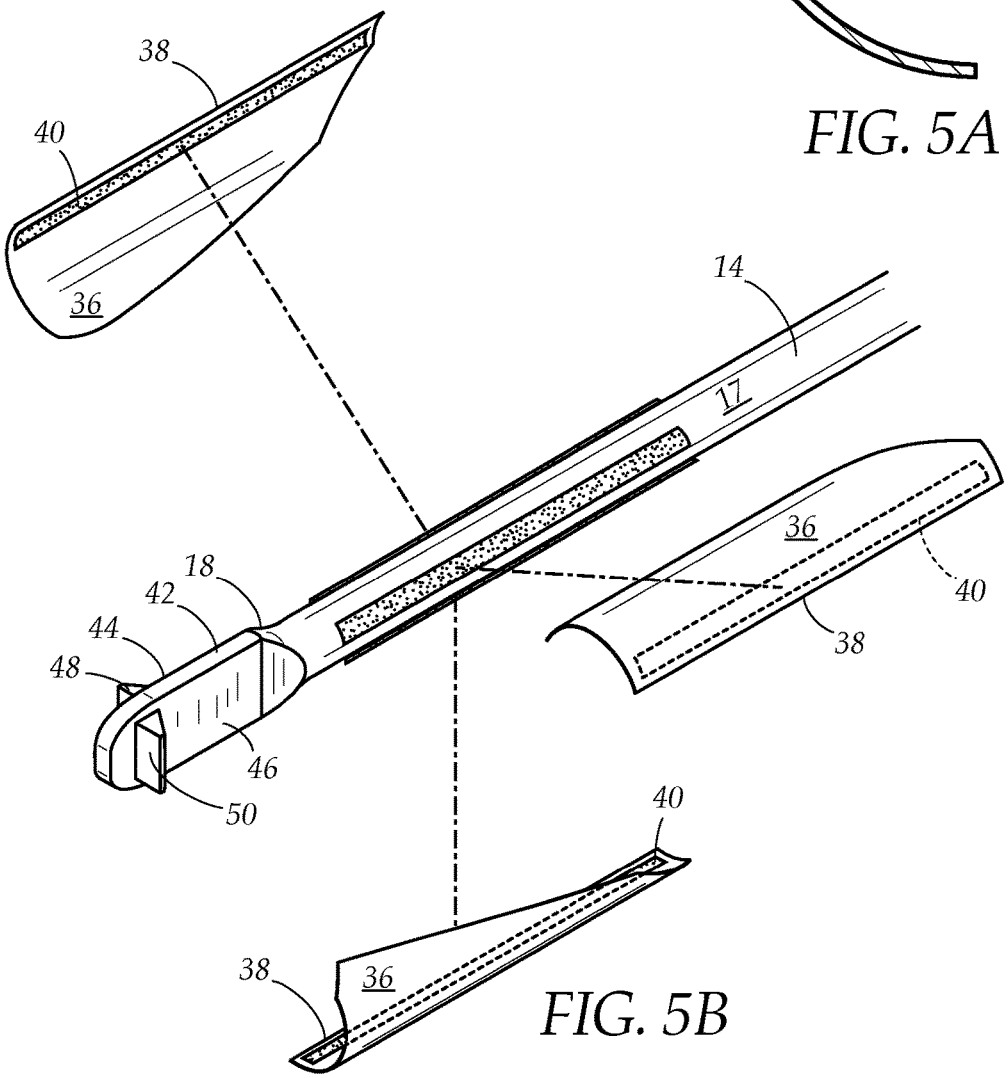
FIG. 5B is a close-up exploded view of the fletching of the tail end of the toy arrow projectile, illustrating one manner in which the fins of the fletching attach to the shaft of the toy arrow projectile according to one embodiment of the present disclosure.

Referring to FIGS. 4-5B, the fletching 26 comprises a plurality of arcuate fins 26A extending along the longitudinal length of the elongated shaft 14 from the tail end 18 toward front end 16. In embodiments, each of the plurality of arcuate fins 26A extend linearly, or straight, along the longitudinal length of the elongated shaft 14 from the tail end 18 towards the front end 16. In some embodiments, each of the plurality of arcuate fins 26A extend straight and offset from the tail end 18 to the front end 16, such that they extend diagonally from the tail end 18 to the front end 16. In other embodiments, each of the plurality of arcuate fins 26A extends along a curved path or helical path along the longitudinal length of the elongated shaft 14. The plurality of arcuate fins 26A comprise a semi-flexible material, such as plastic, feathers, or the like.

The fletching 26 curves annularly around the elongated shaft 14 so as to circumscribe at least a portion of the elongated shaft 14. Each of the plurality of arcuate fins 26A includes a curved surface 36 that curves circumferentially about the diameter of the elongated shaft 14. Since the curved surfaces 36 are curved, they extend outwardly from the elongated shaft 14 along a curved path. In this way, the plurality of arcuate fins 26A overlap one another as the curved surfaces 36 extend outwardly from the elongated shaft 14. The fletching 26 includes a cross-sectional diameter $d_c$ having a length smaller than a length of the distance between the pair of hook elements 20, 22. In other words, each of the plurality of arcuate fins 26A includes a height, measured from the elongated shaft 14, that is less than a height of each of the pair of hook elements 20, 22, measured from the elongated shaft 14.

The cross-sectional diameter $d_c$ of the fletching 26 is smaller than the size of the gap 30 (see FIG. 1) formed by the first and second launching elements 27, 28 (see FIG. 1) of the toy projectile launching assembly 12 (see FIG. 1). In this way, the extent to which the first and second launching elements 27, 28 obstruct the toy arrow projectile 10 during launch by striking, rubbing, or otherwise engaging the fletching 26 as the toy arrow projectile 10 passes through the gap 30 is greatly minimized. The less the fletching 26 strikes the first and second launching elements 27, 28 the more the structural integrity of the fletching 26 and the launching elements 27, 28 is preserved. In some embodiments, the cross-sectional diameter $d_c$ of the fletching 26 is less than a diameter of the safety-tipped arrowhead 24.

The arcuate fletching 26, which is formed by the plurality of arcuate fins 26A, produces more spin in the toy arrow projectile 10 during flight, producing stability into two ways. First, is gyroscopic stability in the direction of motion of the toy arrow projectile 10. Spinning the toy arrow 10 creates angular momentum in the toy arrow projectile 10, which is resistant to change. The forward impulse in the direction of the toy projectile arrow 10 is maintained because any forces that jog it autocorrect back to the line of flight. The conservation of angular momentum along the direction of flight of the toy arrow projectile 10 reduces tumbling. Second, once tumbling is reduced, resistance due to air friction is minimized. Thus, the toy arrow projectile 10 cuts through the air faster. Further, it stays fast because less energy is lost to creating turbulent air, and it stays straighter because less turbulence means less air pressure throwing the toy arrow projectile 10 off of its flight path.

The curved surfaces 36 of each of the plurality or arcuate fins 26A are attached to the curved surface 17 of the elongated shaft 14 such that at least a portion of the curved surface 36 of each of the plurality of arcuate fins 26A rests flat on the curved surface 17 of the elongated shaft 14. In embodiments, the curved surfaces 36 of each of the plurality of arcuate fins 26A defines a longitudinal edge 38 including an adhesive 40 for attaching the curved surfaces 36 of each of the plurality of arcuate fins 26A to the curved surface of the elongated shaft 14.

In embodiments, the tail end 18 of the elongated shaft 14 comprises a flange 42 extending outwardly therefrom. The flange 42 provides an area for a user to grasp in order to pull the toy arrow projectile 10 and draw the launching elements of a toy projectile launching assembly when loaded thereon. The flange 42 provides planar member includes a first planar side 44, a second planar side 46 opposite the first planar side 44, a first notch 48 disposed on the first planar side 44, and a second notch 50 disposed on the second planar side 46. The flange 42 is coplanar with the elongated shaft 14 and extends parallel relative to the elongated shaft 14. In some embodiments, the flange 42 comprises a height larger than the diameter of the elongated shaft 14 and a width smaller than a diameter of the elongated shaft 14.

The first notch 48 and the second notch 50 extend substantially orthogonally outwardly from the first planar side 44 and second planar side 46, respectively, thereby providing a grip that is substantially orthogonal to the elongated shaft 14. In this way, a user can produce more leverage when drawing the launching elements of the toy projectile launching assembly to stretch the launching elements further. In some embodiments, the first notch 48 is offset from the second notch 50 so as to provide comfort to a user's hand/fingers when grasping and/or to accommodate specific fingers of the user.

Figure 6:
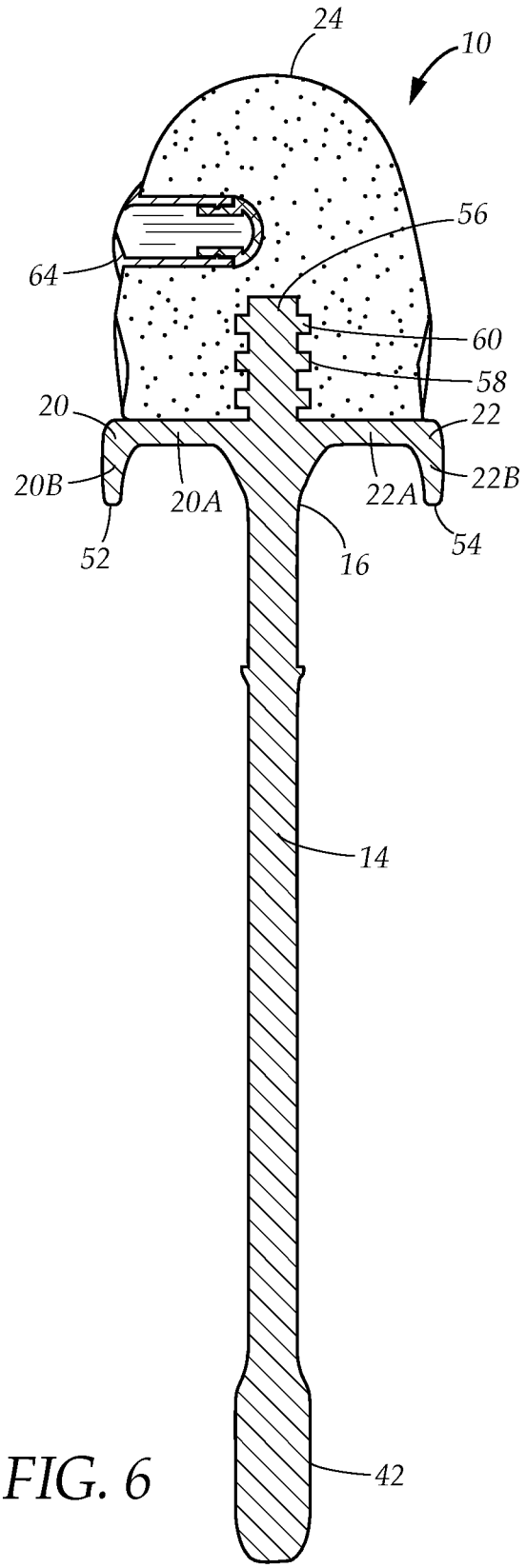
FIG. 6 is a side cross-sectional view of the toy arrow projectile, illustrating one manner in which the front end of the shaft engages the head of the toy arrow projectile as well as the positioning of the whistle within the head of the toy arrow projectile according to one embodiment of the present disclosure.

Referring to FIG. 6, in conjunction with FIG. 4, each of the pair of hook elements 20, 22 includes a first portion 20A, 22A extending substantially orthogonally outwardly from the front end 16 of the elongated shaft 14 and a second portion 20B, 22B extending substantially parallel relative to the elongated shaft 14. The second portions 20B, 22B extend away from the front end 16 of the elongated shaft 14 towards the tail end 18 of the elongated shaft 14. The second portion 20B defines a first hook 52 and the second portion 22B defines a second hook 54. The first hook 52 is configured to engage a the first launching element 27 (see FIG. 1) of the toy projectile launching assembly 12 (see FIG. 1) and the second hook 54 is configured to engage the second launching element 28 (see FIG. 1) of the toy projectile launching assembly 12. The first hook 52 and the second hook 54 are configured to draw the first and second launching elements 27, 28 to launch the toy arrow projectile 10.

The elongated shaft 14 comprises a fastening rod 56 extending outwardly from the front end 16. The fastening rod 56 is coplanar with the elongated shaft 14 and the flange 42 and extends parallel relative to the elongated shaft 14 and flange 42. The toy arrowhead 24 includes an aperture 58 configured to removably engage the fastening rod 56. In embodiments, the fastening rod 56 includes threads 60 and the aperture 58 of the toy arrowhead 24 is threaded, such that the fastening rod is configured to threadably engage the aperture 58. In some embodiments, the fastening rod 56 includes ribs 62 configured to engage the aperture 58 so as to fixedly secure the fastening rod 56 therein. The toy arrowhead 24 includes a whistle 64 extending partially therethrough. The whistle 64 is configured to make sound effects while the toy arrow projectile 10 is in flight. In some embodiments, the whistle 64 extends substantially orthogonally relative to the surface of the toy arrowhead 24.

Figure 2:
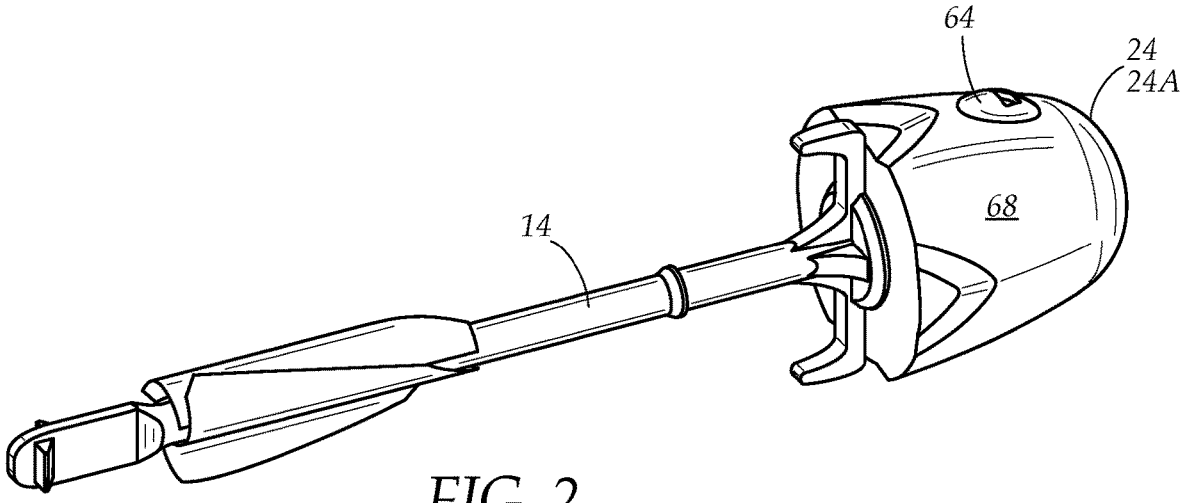
FIG. 2 is a perspective view of the toy arrow projectile, illustrating one variation of the interchangeable head according to one embodiment of the present disclosure.
Figure 3:
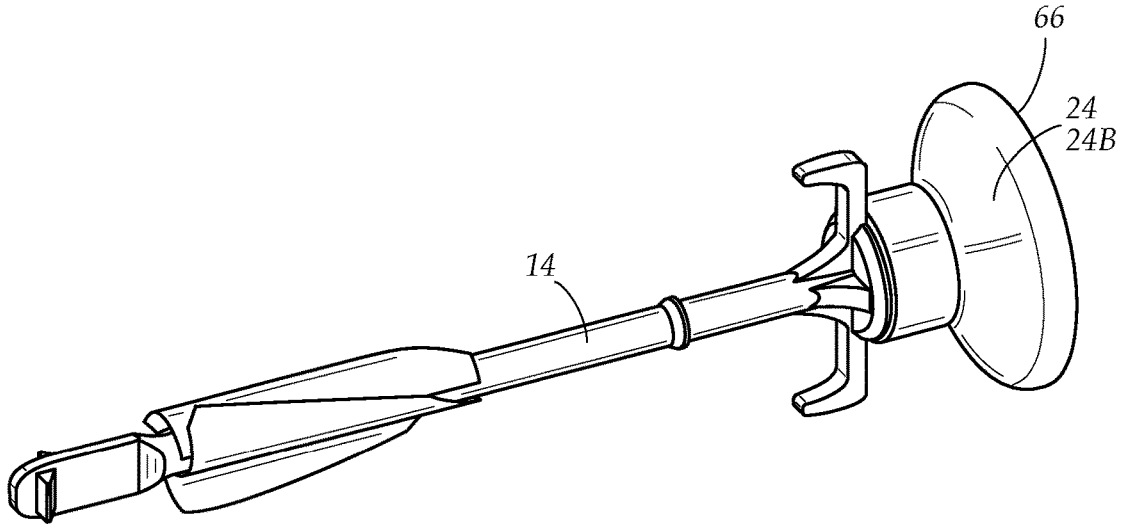
FIG. 3 is a perspective view of the toy arrow projectile, illustrating another variation of the interchangeable head according to one embodiment of the present disclosure.

Referring to FIGS. 2 and 3, in conjunction with FIG. 4, the toy arrowhead 24 comprises interchangeable heads including a conically shaped head 24A having the the whistle 64 and a circular shaped head 24B having a suction cup 66 configured to adhere to a surface when striking the surface, such as the surface of a wall, target, or floor. The conically shaped head 24A comprises an exterior surface 68 including an aperture 70 extending partially through the conically shaped head 24A in which the whistle 64 is mounted. In embodiments, the aperture 70 is orthogonal relative to the aperture 58. The suction cup 66 of the circular shaped head 24B faces away from the elongated shaft 14. Each of the interchangeable heads 24A, 24B include a diameter larger than the diameter of the elongated shaft 14. The toy arrowheads 24 are safety-tipped in that they are designed for use in children's play.

Figure 7:
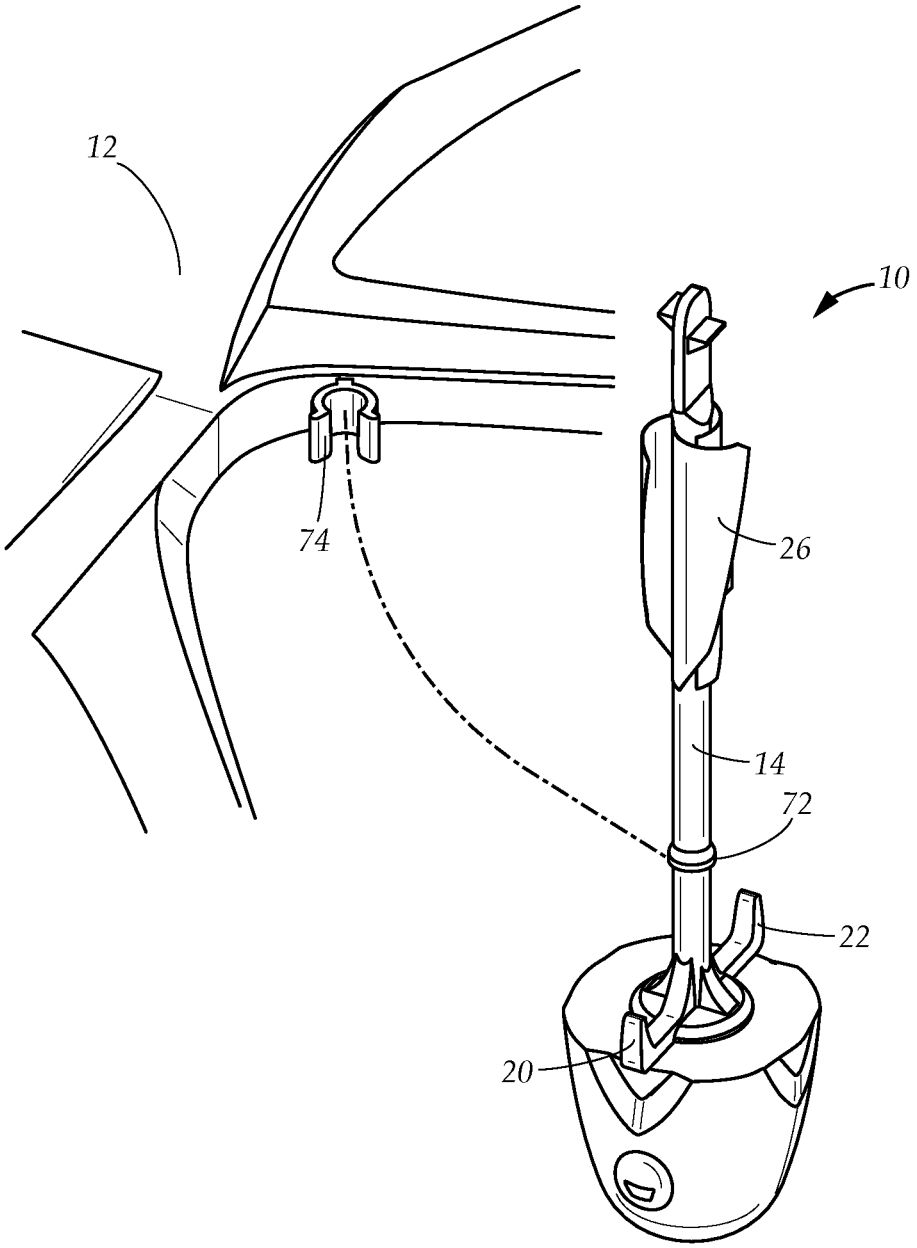
FIG. 7 is a perspective view of the toy arrow projectile, illustrating one manner in which the rib along the shaft of the toy arrow projectile engages the toy arrow projectile fasteners of the toy projectile launching assembly.

Referring to FIG. 7, the elongated shaft 14 includes an annular rib 72 disposed between the fletching 26 and the pair of hook elements 20, 22. The annular rib 72 is configured to removably engage a fastening clip 74 disposed on the toy projectile launching assembly 12 so as to secure the toy arrow projectile 10 thereto.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a toy arrow projectile. The disclosure is illustrated by example in the drawing figures, and throughout the written description. It should be understood that numerous variations are possible, while adhering to the inventive concept. Such variations are contemplated as being a part of the present disclosure.

What is claimed is:

1. A toy arrow projectile for use with a toy projectile launching assembly, comprising:

an elongated shaft including a front end, a tail end, the front end opposite the tail end, a longitudinal length, a diameter, and a curved surface;

a pair of hook elements extending outwardly from the front end, the pair of hook elements opposite each other;

a safety-tipped toy arrowhead attached to the front end, the toy arrowhead adjacent to the pair of hook elements; and fletching disposed on the tail end, the fletching including a plurality of arcuate fins extending along the longitudinal length of the elongated shaft toward the front end, the plurality of arcuate fins overlapping one another and including a curved surface that curves circumferentially about the diameter of the elongated shaft, the fletching curving annularly around the elongated shaft to circumscribe at least a portion of the elongated shaft, the fletching including a cross-sectional diameter having a length smaller than a length of the distance between the pair of hook elements.

2. The toy arrow projectile of claim 1, wherein each of the plurality of arcuate fins extends linearly along the longitudinal length of the elongated shaft towards the front end.

3. The toy arrow projectile of claim 2, wherein each of the plurality of arcuate fins extend straight and offset from the tail end to the front end.

4. The toy arrow projectile of claim 1, wherein each of the plurality of arcuate fins extends along a curved path along the longitudinal length of the elongated shaft towards the front end.

5. The toy arrow projectile of claim 4, wherein the curved surfaces of each of the plurality or arcuate fins are attached to the curved surface of the elongated shaft such that at least a portion of the curved surface of each of the plurality of arcuate fins rests flat on the curved surface of the elongated shaft.

6. The toy arrow projectile of claim 5, wherein the curved surfaces of each of the plurality of arcuate fins defines a longitudinal edge including an adhesive for attaching the curved surfaces of the plurality of arcuate fins to the curved surface of the elongated shaft.

7. The toy arrow projectile of claim 1, wherein the toy arrowhead includes a diameter larger than the diameter of the elongated shaft.

8. The toy arrow projectile of claim 7, wherein each of the pair of hook elements includes a first portion extending substantially orthogonally outwardly from the front end of the elongated shaft and a second portion extending substantially parallel relative to the elongated shaft.

9. The toy arrow projectile of claim 8, wherein the second portion extends away from the front end of the elongated shaft towards the tail end of the elongated shaft.

10. The toy arrow projectile of claim 9, wherein the pair of hook elements include a first hook and a second hook, the first hook configured to engage a first launching element and the second hook configured to engage a second launching element, the first launching element and the second launching element extending horizontally parallel relative to each other, the first hook and the second hook configured to draw the first launching element and the second launching element to launch the toy arrow projectile.

11. The toy arrow projectile of claim 10, wherein the tail end comprises a flange extending outwardly therefrom, the flange coplanar with the elongated shaft and including a first side, a second side, the first side opposite the second side, a first notch disposed on the first side, and a second notch disposed on the second side, the first notch offset from the second notch.

12. The toy arrow projectile of claim 11, wherein the toy arrowhead comprises interchangeable heads including at least one of:

a conically shaped head including a whistle configured to make sound effects while the toy arrow projectile is in flight; and a circular shaped head including a suction cup configured to adhere to a surface when striking the surface.

13. The toy arrow projectile of claim 12, wherein:

the elongated shaft comprises a fastening rod extending outwardly from the front end, the fastening rod coplanar with the elongated shaft; and the toy arrowhead includes an aperture configured to removably engage the fastening rod.

14. The toy arrow projectile of claim 13, wherein:

the fastening rod is threaded; and the aperture is threaded;

wherein the fastening rod is configured to threadably engage the aperture.

15. The toy arrow projectile of claim 14, wherein the elongated shaft includes an annular rib disposed between the fletching and the pair of hook elements, the annular rib configured to removably engage a fastening clip.

* * * * *